US012697560B2

(12) United States Patent
Kam

(10) Patent No.: US 12,697,560 B2
(45) Date of Patent: Aug. 4, 2026

(54) LAUNCHER HAVING ELONGATED POST FOR HOLDING AND LAUNCHING MULTIPLE SPINNING TOYS AT THE SAME TIME

(71) Applicant: Ao Jie Plastic Toys Factory Ltd., Kwun Tong (HK)

(72) Inventor: Chi Hang Kam, Kwun Tong (HK)

(73) Assignee: Ao Jie Plastic Toys Factory Ltd., Kwun Tong (HK)

( * ) Notice: Subject to any disclaimer, the term of this patent is extended or adjusted under 35 U.S.C. 154(b) by 182 days.

(21) Appl. No.: 18/643,484

(22) Filed: Apr. 23, 2024

(65) Prior Publication Data

US 2025/0325918 A1 Oct. 23, 2025

(51) Int. Cl.
*A63H 27/14* (2006.01)

(52) U.S. Cl.
CPC ..... *A63H 27/14* (2013.01)

(58) Field of Classification Search
CPC ..... A63H 27/12; A63H 27/14
See application file for complete search history.

(56) References Cited

U.S. PATENT DOCUMENTS

| | | | | |
|---|---|---|---|---|
| 447,284 | A | 2/1891 | Del Valle | |
| 481,182 | A | 8/1892 | Lochmann | |
| 1,146,333 | A | 7/1915 | King | |
| 1,264,733 | A * | 4/1918 | Williams | A63H 27/14 446/43 |
| 1,552,093 | A | 9/1925 | Thompson | |
| 1,843,636 | A * | 2/1932 | Voellmecke | A63H 27/14 446/43 |
| 2,242,770 | A | 5/1941 | Ayers | |
| 2,969,609 | A * | 1/1961 | Kowalski | A63H 27/14 446/43 |
| 3,246,424 | A | 4/1966 | Gregory | |
| 4,781,642 | A | 11/1988 | Stanzel | |
| 2007/0117492 | A1 | 5/2007 | Sze et al. | |
| 2009/0013983 | A1 * | 1/2009 | Polk, III | A63H 27/14 124/6 |

* cited by examiner

*Primary Examiner* — Kimberly S Berona
(74) *Attorney, Agent, or Firm* — LaMorte & Associates, P.C.

(57) ABSTRACT

A toy assembly having a launcher that can launch more than one flying toy spinner. The flying toy spinner has a central hub and propeller blades. A post opening is formed through said central hub. The launcher has a launch post and a spinning mechanism for selectively causing launch post to spin. The launch post is sized to pass through the post opening in the flying toy spinner. The launch post contains at least one helical flute that drives the toy spinner off the free end of launch post when the launch post is spun by the spinning mechanism. The launch post has a post length that is at least three times the thickness of the flying toy spinner. As such, multiple flying toy spinner can be loaded onto the launch post at the same time, wherein all can be launched at once.

12 Claims, 6 Drawing Sheets

LAUNCHER HAVING ELONGATED POST FOR HOLDING AND LAUNCHING MULTIPLE SPINNING TOYS AT THE SAME TIME

BACKGROUND OF THE INVENTION

1. Field of the Invention

In general, the present invention relates to launchers that are used to launch flying toy spinners. More particularly, the present invention relates to the interface between the launcher and the flying toy spinner that governs how the flying toy spinner is loaded onto the launcher and launched into flight.

2. Description of the Prior Art

Flying toy spinners are toys that contain wings or propeller blades that are mounted to a central point. The flying toy spinner is temporarily connected to a launcher. The launcher has a pull string and can transfer rotational energy to the flying toy spinner when the pull string is manually pulled. When the flying toy spinner is rotated, the toy produces lift and begins to fly. Such toys have been in the marketplace for over a century and are exemplified by U.S. Pat. No. 1, 146, 333 to King, U.S. Pat. No. 1,552,093 to Thompson, and U.S. Pat. No. 2, 242, 770 to Ayers.

Over the years, the toy industry has generally adapted a common disc-shaped design for the flying toy spinner. The adapted design has a central hub and propeller blades that radially extend from the central hub. A safety ring encircles the propeller blades to prevent the propeller blades from causing any damage or harm on contact with a person or delicate item. Such a design for a flying toy spinner is disclosed in U.S. Pat. No. 3,246, 424 to Gregory.

A problem associated with such disc-shaped toy spinners is that it is difficult to transfer rotational energy to the thin shape of the disc. Launchers, such as that shown in the Gregory Patent, have a first post for engaging the central hub of the toy spinner and a second post that engages propeller blades. The second post rotates around the first post to provide rotational energy to the toy spinner. This double post design commonly interferes with the flight of the toy spinner due to the toy spinner accidentally contacting the second post as it lifts away from the first post. Furthermore, the use of a double post design is well known for causing tangling, especially if it accidently contacts a child's hair during use.

One solution to this problem has been to move away from the preferred disc shape by adding a stem to the toy spinner. Rotational energy is then imparted to the stem. Such prior art is exemplified by U.S. Patent Application Publication No. 2007/0117492 to Sze. Another solution to this problem that keeps the preferred disc shape has been to make the central hub of the disc-shaped toy spinner larger. The enlarged central hub is provided with hooks or depressions that enable rotational energy to be imparted directly to the central hub. However, by making the central hub larger, the propeller blades become smaller and the toy spinner loses both lift and flight time. Furthermore, launching systems that impart rotational energy to either a stem or a central hub prevents a launcher from launching more than one toy spinner at a time.

A need therefore exists for an improved flying toy spinner and launcher system that can launch disc-shaped toy spinners without stems and enable multiple toy spinners to be launched at the same time. This need is met by the present invention as described and claimed below.

SUMMARY OF THE INVENTION

The present invention is a toy assembly having a launcher that can launch more than one flying toy spinner. The flying toy spinner has a central hub and propeller blades that radially extend from the central hub. A post opening is formed through said central hub.

The launcher has a launch post and a spinning mechanism for selectively causing launch post to spin. The launch post has a free end and is sized to pass through said post opening in the flying toy spinner. The launch post causes the toy spinner to spin with the launch post when the toy spinner is engaged with the launch post.

The launch post contains at least one helical flute that drives the toy spinner off the free end of launch post when the launch post is spun by the spinning mechanism. The launch post has a post length that is at least three times the thickness of the flying toy spinner. As such, multiple flying toy spinner can be loaded onto the launch post at the same time, wherein all can be launched at once.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention launcher system for flying toy spinners can be embodied in many ways only two exemplary embodiments are illustrated and described. The exemplary embodiments to set forth two of the best modes contemplated for the invention. However, the illustrated embodiments are only intended to be exemplary and should not be considered as limiting other possible embodiments of the invention covered within the scope of the claims.

Figure 1:
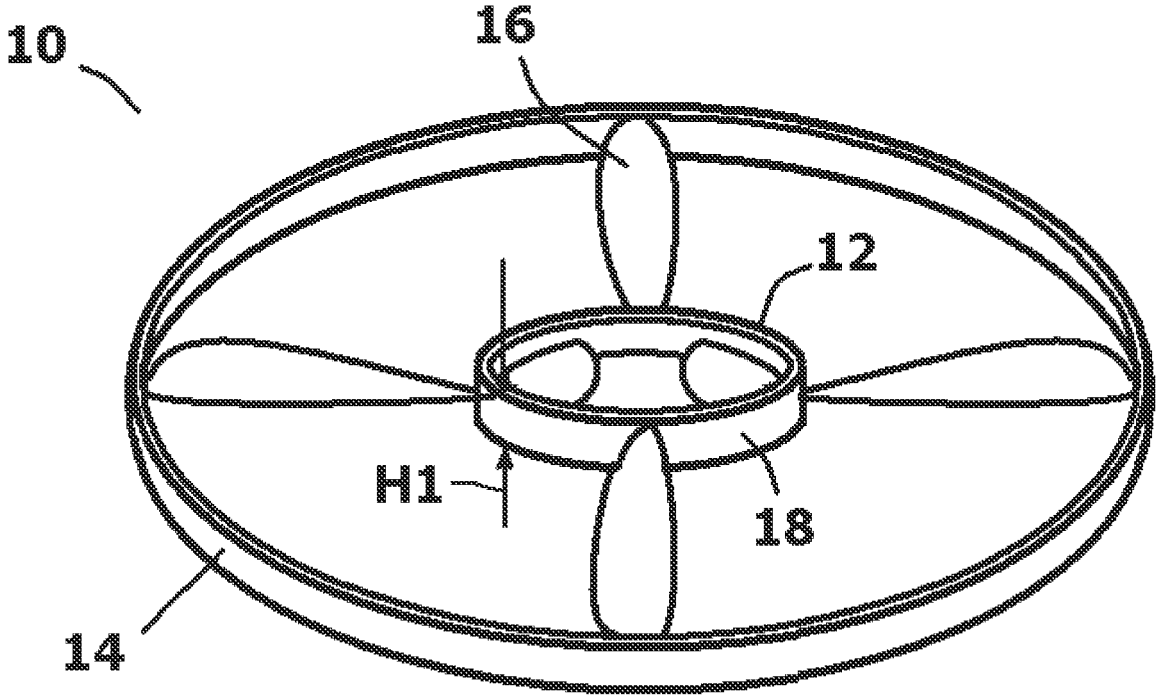
FIG. 1 is a perspective view of an exemplary embodiment of a toy spinner.
Figure 2:
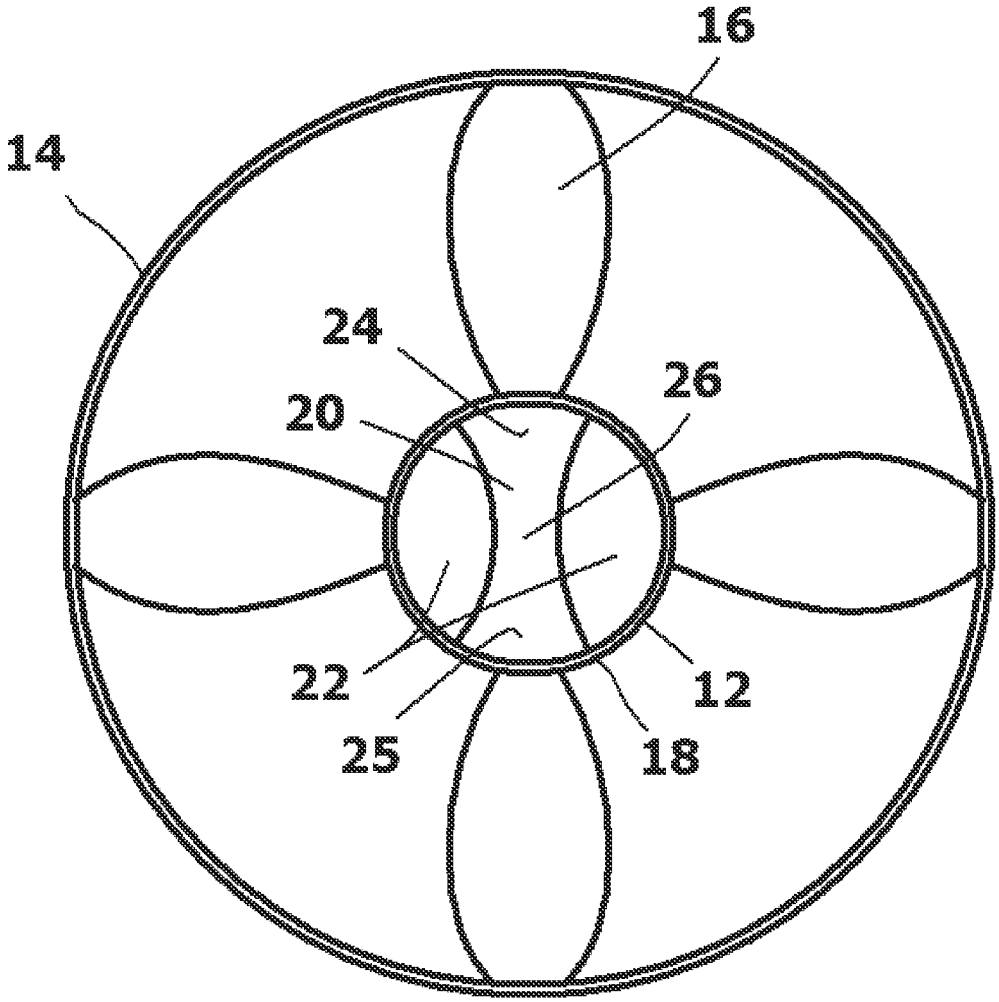
FIG. 2 is a top view of the embodiment of the toy spinner shown in FIG. 1.

Referring to FIG. 1 and FIG. 2, a flying toy spinner 10 is shown. The toy spinner 10 is generally disc-shaped and has a central hub 12 and an outer safety ring 14 that are concentric. Propeller blades 16 radially extend from the central hub 12 to the safety ring 14. The propeller blades 16 are all oriented to create lift in a common direction when the toy spinner 10 is rotated. The propeller blades 16 are all identical and are symmetrically disposed around the central hub 12. The propeller blades 16 can number from two to six.

The central hub 12 is not solid. Rather, the central hub 12 has a hub wall 18 that defines a post opening 20. The hub wall 18 has a constant height H1 along its periphery. The height H1 is preferably the same as the height of the safety ring 14 and serves as the maximum height of the toy spinner 10. Arcuate protrusions 22 extend inwardly from opposite sides of the hub wall 18, therein providing the post opening 20 with a generally hourglass shape. The post opening 20 has two opposite wide ends 24, 25 and a middle 26 that is narrower than either of the wide ends 24, 25.

Figure 3:
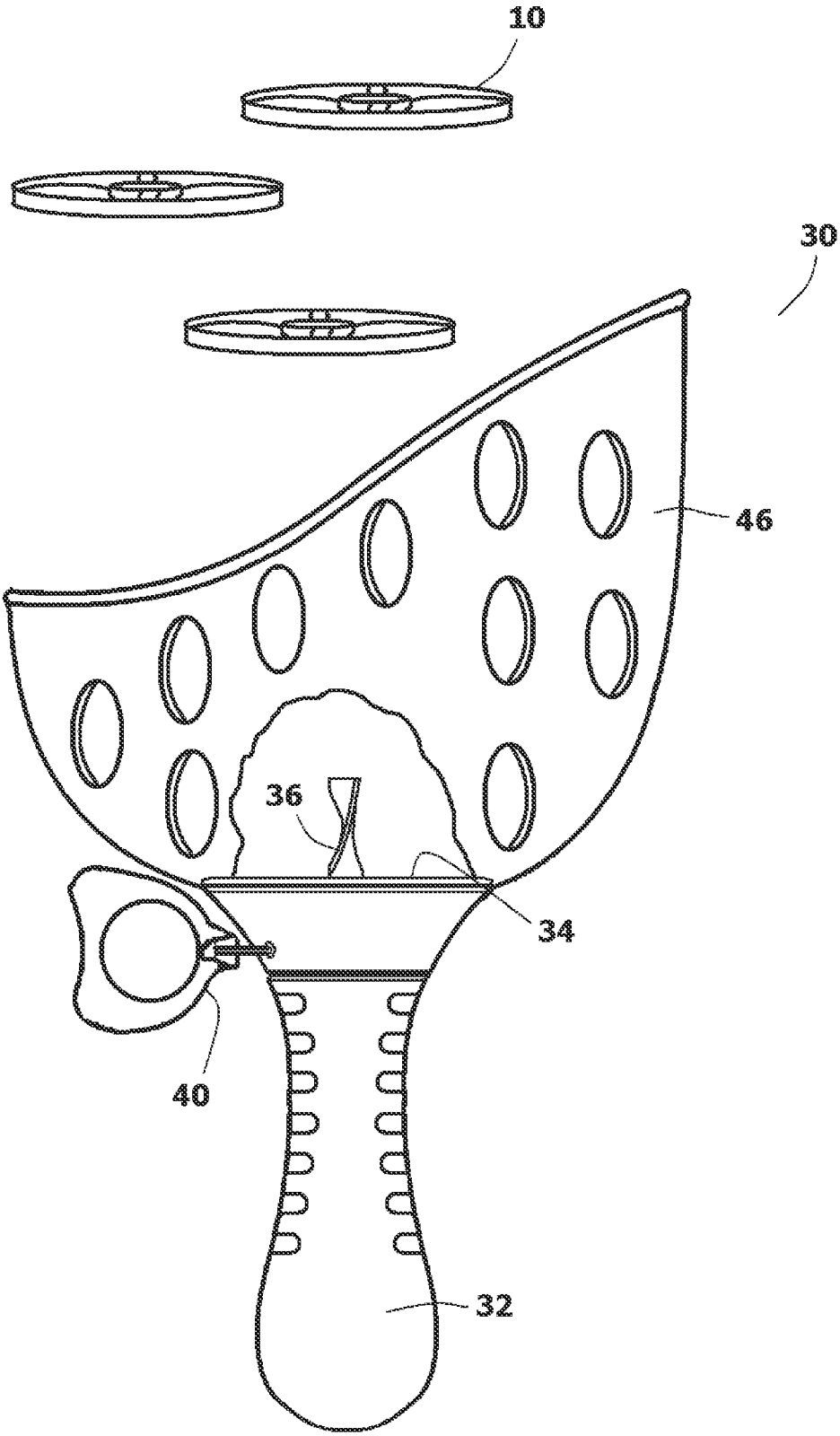
FIG. 3 is a partially fragmented view of a toy system containing the exemplary embodiment of a toy spinner and an exemplary embodiment of a handheld launcher.
Figure 4:
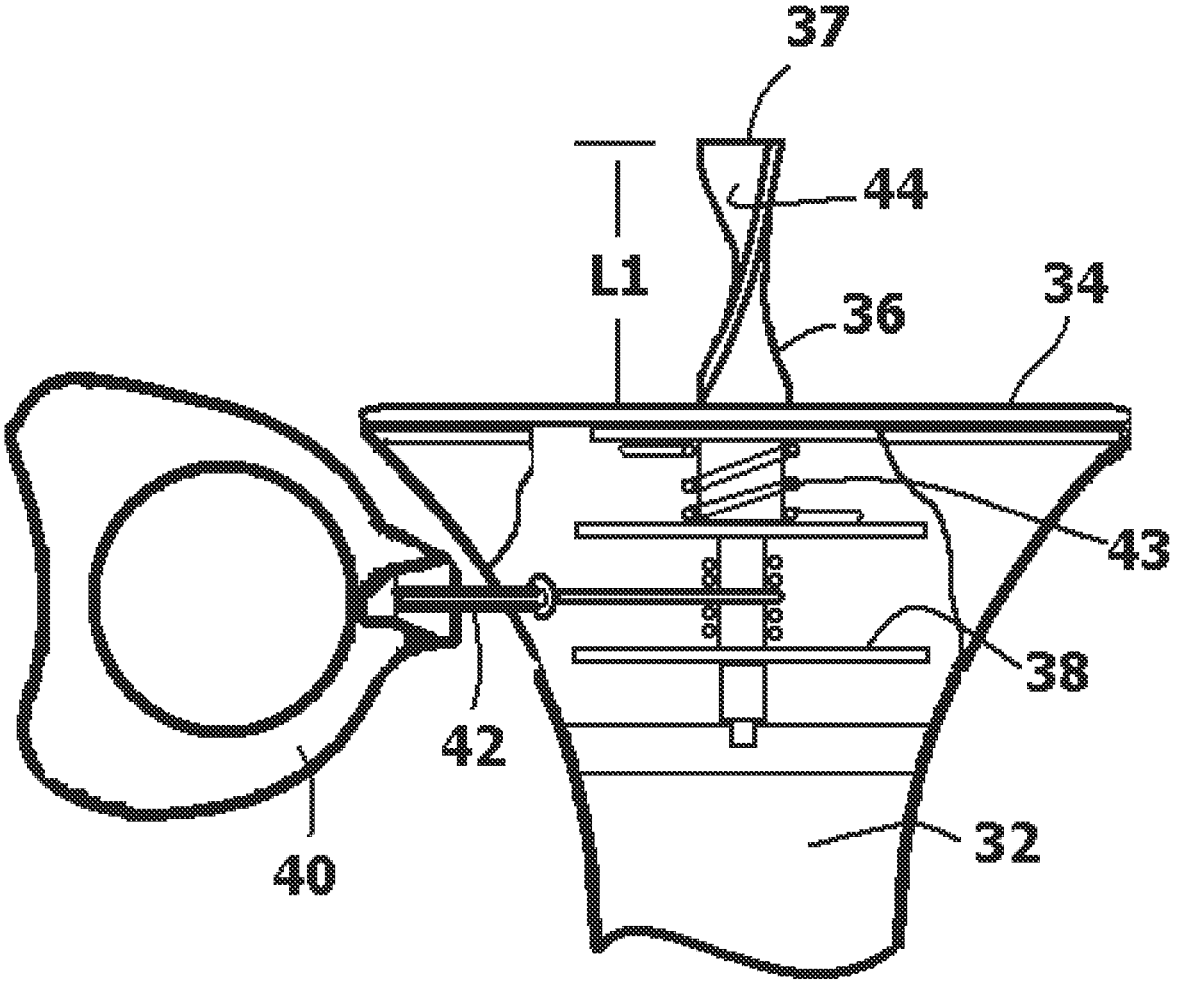
FIG. 4 is an enlarged view of the launch post atop the handle of the handheld launcher of FIG. 3.

Referring to FIG. 3 in conjunction with FIG. 4, a first embodiment of a toy system 28 is shown that has a launcher assembly 30 for launching one or more of the toy spinners 10. The launcher assembly 30 has the ability to launch one or more flying toy spinners 10 at the same time. The launcher assembly 30 has a handle 32 with a top surface 34. A launch post 36 extends from the top surface 34 of the handle 32. The launch post 36 is part of a spindle 38 that extends into the handle 32 through the top surface 34 of the handle 32 and terminates at a free end 37. A spinning mechanism 40 is provided for selectively causing the spindle 38 to spin. The spinning mechanism 40 can be manually powered or battery powered. In the shown embodiment, the spinning mechanism 40 is a pull string 42. The pull string 42 is wound around the spindle 38. When the pull spring 42 is pulled, the spindle 38 turns and the launch post 36 spins relative to the handle 32. The spindle 38 can also be connected to a retraction spring 43. In this manner, once the pull string 42 is pulled and the spindle 38 turns, the pull string 42 can automatically rewind under the power of the retraction spring 43.

Figure 5:
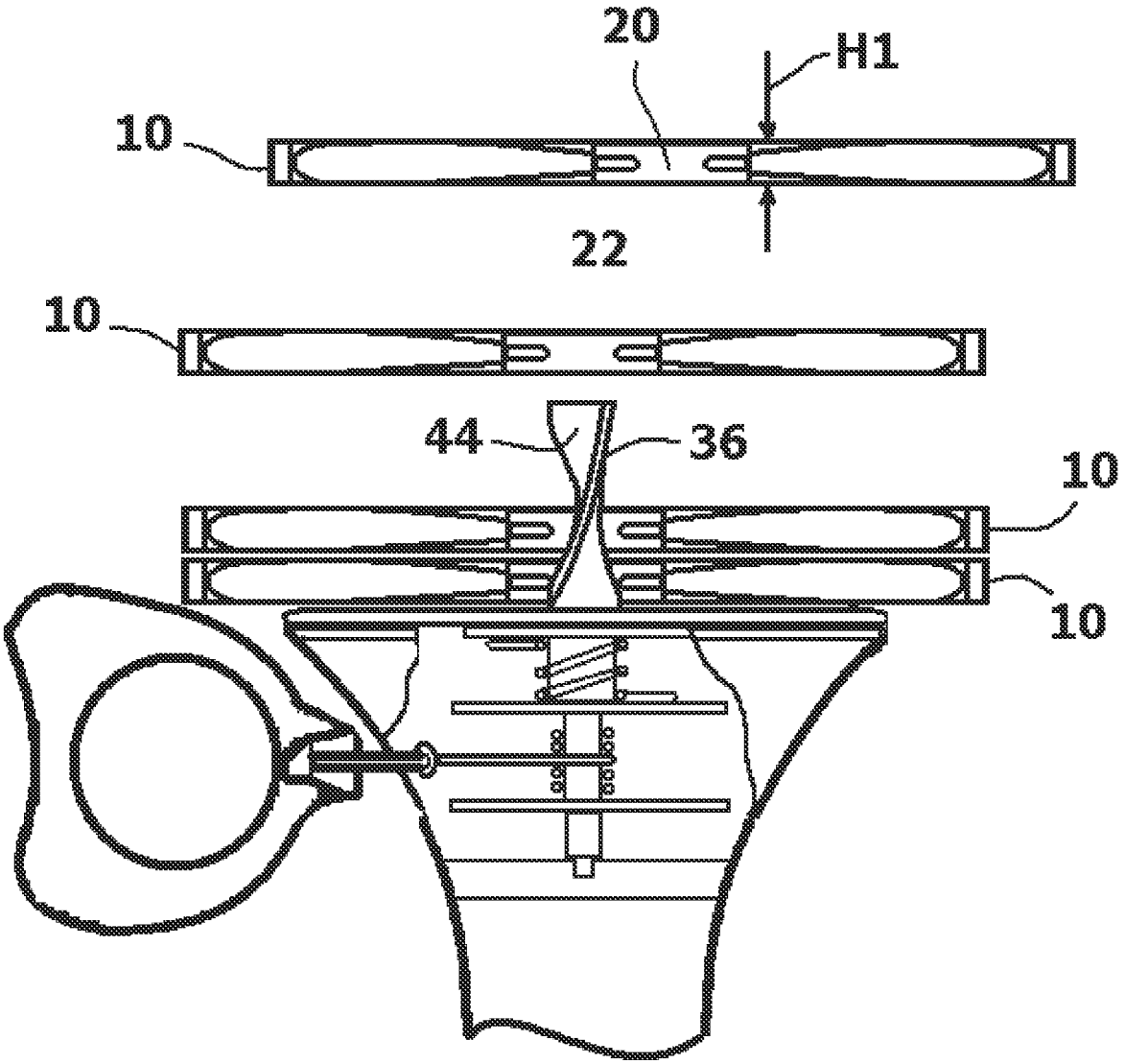
FIG. 5 is an enlarged view of the launch post of FIG. 4 shown in conjunction with a plurality of toy spinners of the type shown in FIG. 1.

Referring to FIG. 5 in conjunction with FIG. 4, it can be seen that the launch post 36 is the part of the spindle 38 that extends beyond the top surface 34 of the handle 32. The launch post 36 has a preferred length L1 of between two and four centimetres and is at least three times longer than the height H1 of the hub wall 18. In a preferred embodiment, the length L1 of the launch post 36 is at least four times longer than the height H1 of the hub wall 18.

The launch post 36 has helical flutings 44 that run along its length L1. Each fluting 44 completes no more than one rotation about the launch post 36 along the full length L1 of the launch post 36. The flutings 44 provide the launch post 36 with a cross-sectional shape that can pass into the post opening 20 in the hub 12 of the toy spinner 10. When the toy spinner 10 is placed onto the launch post 36, the arcuate protrusions 22 at the post opening 20 follow the flutings 44 on the launch post 36. Once the toy spinner 10 is engaged with the launch post 36, the toy spinner 10 cannot rotate independently of the launch post 36 and is forced to rotate when the launch post 36 rotates. When the launch post 36 rotates, the helical flutings 44 also act as threads that mechanically drive the toy spinner 10 up and off the launch post 36. Accordingly, the launch post 36 both rotates the toy spinner 10 and simultaneously applies a force to the toy spinner 10 that drives the toy spinner 10 up and away from the handle 32. The force is created by the helical flutings 44 and is independent of the lift created by the toy spinner 10 as it spins.

It will be understood that when the spin mechanism 40 is activated, the launch post 36 rapidly spins. This causes the toy spinner 10 to rotate and generate lift. As lift is produced, the arcuate protrusions 22 on the central hub 12 follow the flutings 44 and lifts the toy spinner 10 off the launch post 36. The toy spinner 10 then flies freely until the weight of the toy spinner 10 overcomes the lift caused by the spinning.

The launch post 36 has a length L1 that enables multiple toy spinners 10 to be loaded onto the launch post 36 at the same time. The length L1 of the launch post 36 is at least long enough to load three toy spinners 10 and is preferably long enough to load at least four toy spinners 10 simultaneously. When the spinning mechanism 40 is activated, the launch post 36 rapidly spins. This causes all the loaded toy spinners 10 to rotate and generate lift. As lift is produced, the toy spinners 10 all follow the flutings 44 and lifts off the launch post 36, one at a time. As a result, multiple toy spinners 10 are launched upon the activation of the spinning mechanism 40 in the handle 32. The toy spinners 10 can be identical, but are preferably more than one color for added play value.

The launcher assembly 30 may have a catch basket 46 (FIG. 3) that partially surrounds the launch post 36. The catch basket 46 can be used to catch the flying toy spinners 10 as they slow and descend. Since the toy spinners 10 can be of assorted colors, games can be played that require the toy spinners 10 to be caught in different sequences. For example, four toy spinners 10 can be launched simultaneously. A player may have to catch the toy spinners 10 of a first color before they catch the toy spinners 10 of the second color.

Figure 6:
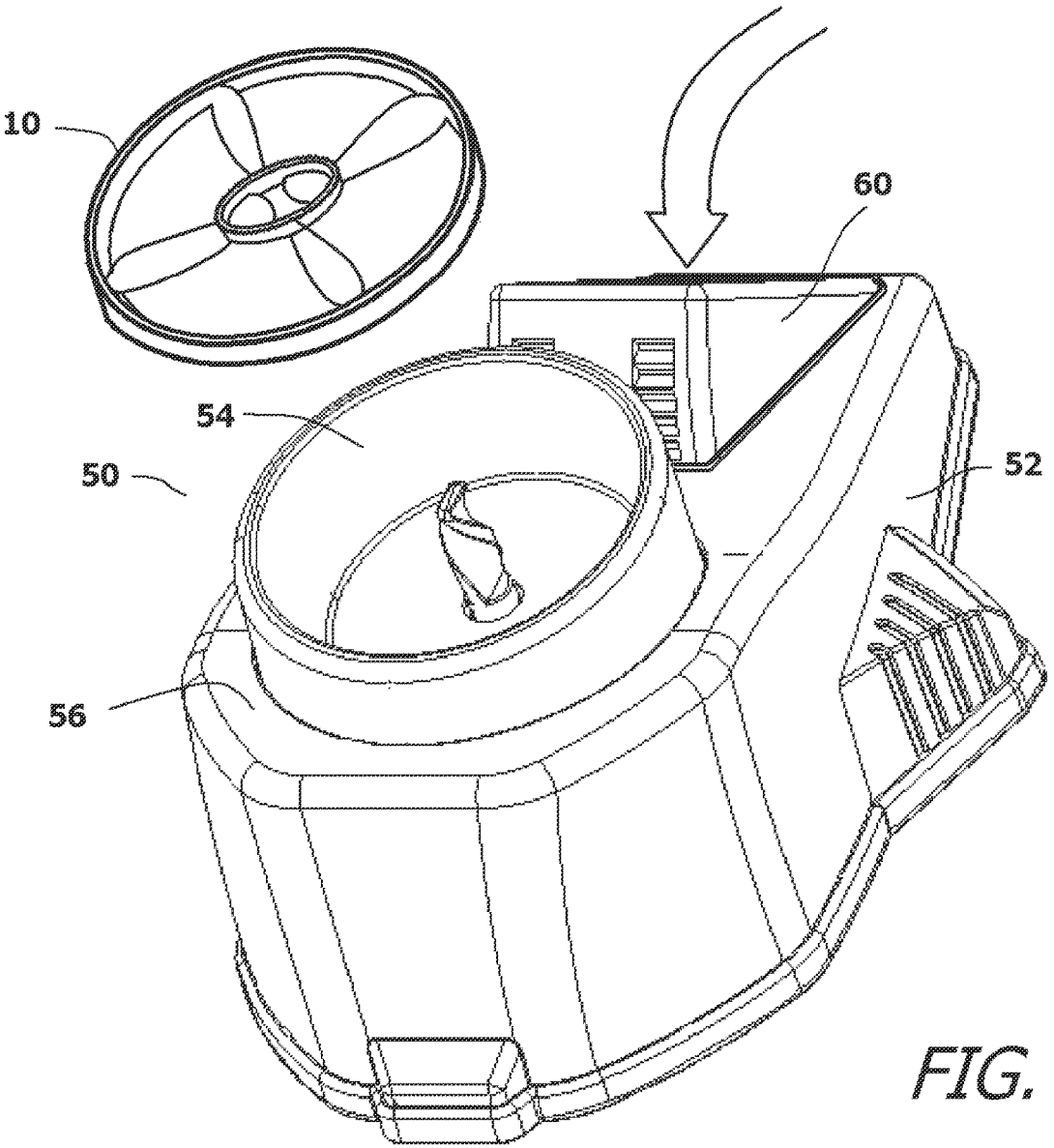
FIG. 6 shows an alternate embodiment of a toy system containing a toy spinner and an exemplary embodiment of a treadle powered launcher.

Referring to FIG. 6, an alternate embodiment of a launcher assembly 50 is shown. In the embodiment of FIG. 6, the launcher assembly 50 is foot operated. In place of a handle, the launcher assembly 50 has a housing 52 that rests upon the ground. The housing 52 has a relief 54 formed on its top surface 56, wherein a launch post 58 is positioned in the center of the relief 54. The launch post 58 is the same as has been previously described and has a length for loading multiple toy spinners 10. The launch post 58 is rotated using a foot treadle 60. The foot treadle 60 is connected to the launch post 58 using a spinning mechanism in the form of an internal gearbox. When the foot treadle 60 is pressed down, the launch post 58 spins.

It will be understood that the embodiments of the present invention that are illustrated and described are merely exemplary and that a person skilled in the art can make many variations of those embodiments. All such variations, modifications and alternate embodiments are intended to be included within the scope of the present invention as defined by the claims.

What is claimed is:

1. A toy assembly comprising:

a toy spinner having a central hub defined within a circular hub wall of a constant height and propeller blades that radially extend from said circular hub wall, wherein a post opening is formed through said central hub;

a launcher having a handle with a top surface, a launch post and a spinning mechanism for selectively causing said launch post to spin, wherein said launch post extends from said top surface of said handle for a length that is at least three times as long as said constant height of circular hub wall, wherein said launch post terminates with a free end and is sized to pass through said post opening in said toy spinner, wherein said launch post causes said toy spinner to spin with said launch post when said toy spinner is engaged with said launch post, and wherein said launch post contains at least one helical flute of a constant major diameter that runs along said length, wherein said at least one helical flute completes no more than one rotation about the launch post along said length, and wherein said at least one helical flute drives said toy spinner off said free end of said launch post when said launch post is caused to spin by said spinning mechanism.

2. The assembly according to claim 1, wherein said toy spinner has protrusions that extend into said post opening, wherein said protrusions follow said at least one helical flute on said launch post as said toy spinner moves along said launch post.

3. The assembly according to claim 1, wherein said spinning mechanism is a pull string.

4. The assembly according to claim 3, wherein said launch post is part of a spindle around which said pull string winds.

5. The assembly according to claim 1, further including a catch basket coupled to said handle.

6. The assembly according to claim 5, wherein said launch post is disposed within said catch basket.

7. A toy assembly comprising:

a toy spinner having central hub of a maximum height, wherein a post opening is formed through said central hub;

a launcher having a handle with a top surface and a launch post that can spin, wherein said launch post extends from said top surface of said handle for a length that is at least three times as long as said maximum height of central hub, wherein said launch post terminates with a free end and is sized to pass through said post opening in said toy spinner, wherein said launch post contains helical flutes with a constant major diameter that runs along said length, wherein each of said helical flutes completes no more than one rotation about the launch post along said length, and wherein said helical flutes drive said toy spinner off said free end of said launch post when said launch post spins.

8. The assembly according to claim 7, wherein said toy spinner has protrusions that follow said helical flutes on said launch post as said toy spinner moves along said launch post.

9. The assembly according to claim 7, further including a pull string for selectively spinning said launch post.

10. The assembly according to claim 9, wherein said launch post is part of a spindle around which said pull string winds.

11. The assembly according to claim 7, further including a catch basket coupled to said handle.

12. The assembly according to claim 11, wherein said launch post is disposed within said catch basket.

* * * * *